US008519894B2

(12) United States Patent
Yang et al.

(10) Patent No.: US 8,519,894 B2
(45) Date of Patent: Aug. 27, 2013

(54) ELECTRONIC APPARATUS AND ANTENNA MODULE THEREOF

(75) Inventors: Chun-Fei Yang, Taipei Hsien (TW); Hung-Chih Fu, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 376 days.

(21) Appl. No.: 12/461,219

(22) Filed: Aug. 5, 2009

(65) Prior Publication Data

US 2010/0289704 A1 Nov. 18, 2010

(30) Foreign Application Priority Data

May 14, 2009 (TW) ..... 98116069 A

(51) Int. Cl.
*H01Q 1/24* (2006.01)

(52) U.S. Cl.
USPC ..... 343/702

(58) Field of Classification Search
USPC ..... 343/702, 700 MS
See application file for complete search history.

(56) References Cited

U.S. PATENT DOCUMENTS

| | | | | |
|---|---|---|---|---|
| 7,321,334 | B2 * | 1/2008 | Yu | 343/702 |
| 7,564,412 | B2 * | 7/2009 | Walker et al. | 343/702 |
| 7,646,350 | B2 | 1/2010 | Chuang et al. | |
| 7,733,276 | B2 * | 6/2010 | Levy et al. | 343/702 |
| 7,777,682 | B2 * | 8/2010 | Yagi | 343/725 |
| 2004/0104853 | A1 | 6/2004 | Chen | |
| 2009/0231206 | A1 * | 9/2009 | Shamblin et al. | 343/700 MS |
| 2009/0315788 | A1 * | 12/2009 | Hirota | 343/702 |
| 2009/0322627 | A1 * | 12/2009 | Sato et al. | 343/702 |

FOREIGN PATENT DOCUMENTS

| | | | |
|---|---|---|---|
| CN | 2852417 | Y | 12/2006 |
| CN | 101291010 | A | 10/2008 |
| TW | 547788 | | 8/2003 |

OTHER PUBLICATIONS

Office action dated Jul. 26, 2012 in corresponding CN Application 200910143285.3 (See p. 7).

* cited by examiner

*Primary Examiner* — Michael C Wimer
*Assistant Examiner* — Hasan Islam
(74) *Attorney, Agent, or Firm* — Bacon & Thomas, PLLC

(57) ABSTRACT

An antenna structure for an electronic apparatus is disclosed. The electronic apparatus comprises a case composed of a first case and a second case, and the first case combines correspondingly with the second case. The antenna structure comprises an antenna element and a system antenna module. The antenna element is disposed on the inner side of the first case and comprises a connection portion. The system antenna module disposed in the case comprises a corresponding connection portion, and the position of the corresponding connection portion corresponds to the connection portion. The connection portion can be in contact with the corresponding connection portion to form an electrical connection between them by combining the first case and the second case.

4 Claims, 5 Drawing Sheets

ELECTRONIC APPARATUS AND ANTENNA MODULE THEREOF

BACKGROUND OF THE INVENTION

1. Field of the Invention

The present invention relates to an electronic apparatus and an antenna structure thereof, and more particularly, to an electronic apparatus and its antenna structure, which can reduce the required inner installation space and save material cost, and can also improve the operation stability of the antenna circuit.

2. Description of the Related Art

Generally, electronic apparatuses are equipped with antenna modules for wireless network transmission. For example, a notebook computer is implemented with an antenna disposed at the display or the system board therein, and the notebook computer is also implemented with a wireless network transmission module at the system board; the wireless network transmission module is electrically coupled with the antenna through a cable to provide signal transmission.

In implementing the antenna and the wireless network transmission module, the relative positions of the antenna and the wireless network transmission module and the space required for containing them should be carefully designed to obtain good signal transmission effects and to save required space. In order to achieve the above object, some have proposed techniques which improve the traditional 3D antenna structures and use laser engraving techniques to form new planar antenna structures, which not only reduce the sizes of antennas but also facilitate more flexible antenna designs.

However, any kind of antenna structure needs cables to connect the antenna and the wireless network transmission module; the cables could cause additional costs to the antenna structure and affect the circuit arrangement. Furthermore, if any cable or circuit connection breaks off, it takes a lot of time and costs for the user or the manufacturer to replace the damaged components.

SUMMARY OF THE INVENTION

It is an object of the present invention to provide an antenna structure which can reduce required inner installation space and save material cost.

In order to achieve the above object, the present invention discloses an antenna structure for an electronic apparatus; the electronic apparatus comprises a case, which comprises a first case and a second case, the first case correspondingly combines with the second case; the antenna structure comprises an antenna element and a system antenna module, the antenna element is disposed on an inner side of the first case, the antenna element comprises a connection portion; the system antenna module is disposed in the case, the system antenna module comprises a corresponding connection portion, wherein a position of the corresponding connection portion corresponds to the connection portion. The connection portion can be in contact with the corresponding connection portion to form an electrical connection between them by combining the first case and the second case. Therefore, when the cases of the electronic apparatus connect with each other, the antenna structure can provide signal transmission through the electrical connection and save circuit implementation cost.

The present invention discloses another antenna structure design for an electronic apparatus; the electronic apparatus comprises a case. The antenna structure comprises an antenna element, a system antenna module and at least one connection circuit, the antenna element is disposed on an inner side of the case, and the system antenna module is disposed in the case. The at least one connection circuit is electrically coupled between the antenna element and the system antenna module for transmitting a signal, wherein the at least one connection circuit is formed in an inner side of the case by a laser engraving method. In this design, the at least one connection circuit is attached to the case to reduce the use of physical circuits and to save the inner installation space.

The present invention discloses another antenna structure design for an electronic apparatus; the electronic apparatus comprises a case. The antenna structure comprises an antenna element, a system antenna module and at least one connection circuit, the antenna element is disposed on an inner side of the case and is formed by a laser engraving method, and the antenna element comprises a connection portion. The system antenna module is disposed in the case; and at least one connection circuit is electrically coupled between the antenna element and the system antenna module for transmitting a signal, the at least one connection circuit is connected with the connection portion by using a screw, a heat fusing method or a spot welding method.

The present invention discloses an electronic apparatus which can apply the above described antenna structures for various design requirements and structural arrangements and can provide antenna transmission functions.

DETAILED DESCRIPTION OF THE PREFERRED EMBODIMENT

The advantages and innovative features of the invention will become more apparent from the following detailed description when taken in conjunction with the accompanying drawings.

Figure 1:
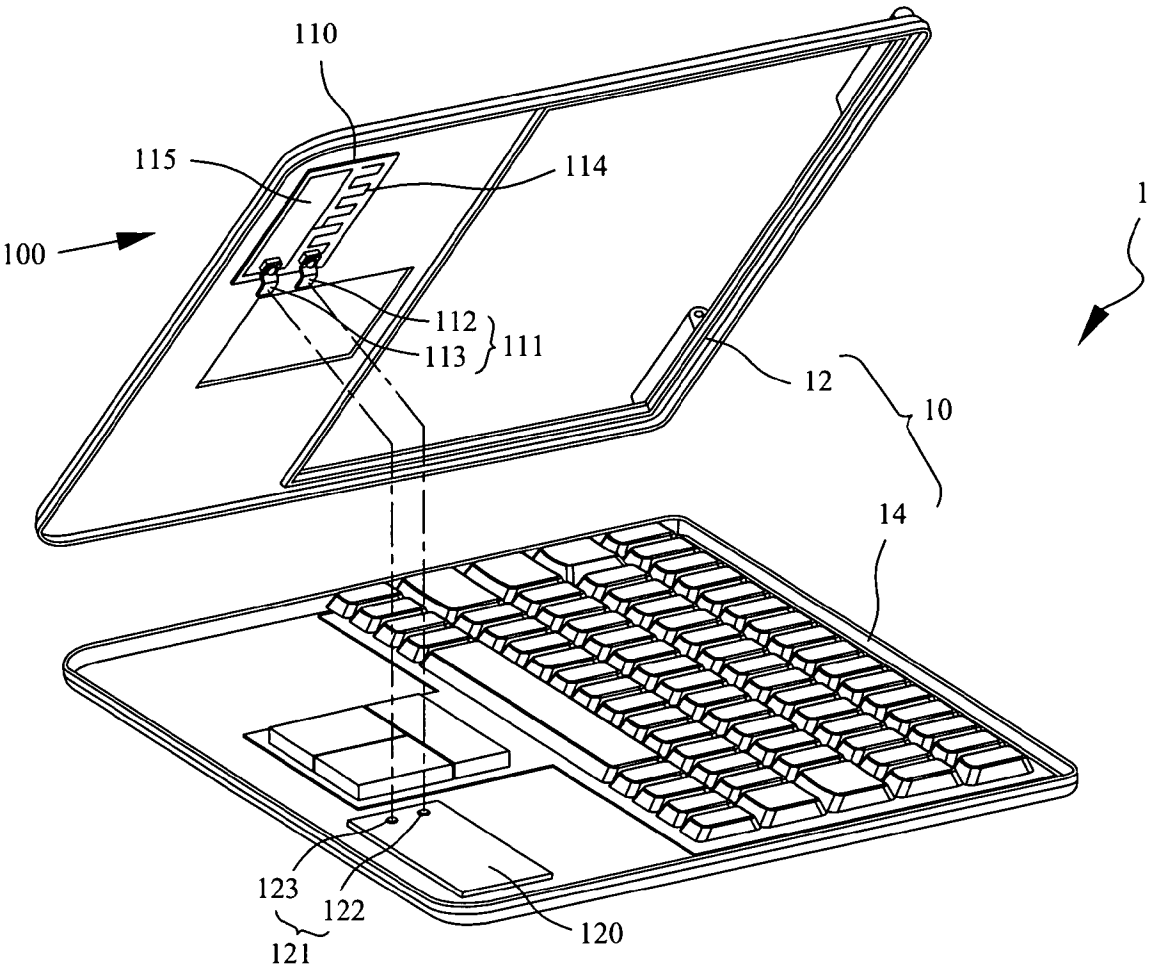
FIG. 1 illustrates a structural view of an antenna structure in a first embodiment of the present invention.

Please refer to FIG. 1 for a structural view of an antenna structure 100 in a first embodiment of the present invention. As shown in FIG. 1, the antenna structure 100 is applied in an electronic apparatus 1, the electronic apparatus 1 comprises a case 10, the case 10 comprises a first case 12 and a second case 14, the first case 12 correspondingly combines with the second case 14. In the following embodiment, the electronic apparatus 1 is illustrated by a notebook computer, but the present invention is not limited thereto. The antenna structure 100 comprises an antenna element 110 and a system antenna module 120, the antenna element 110 is disposed on the inner side of the first case 12, in this embodiment, the pattern of the antenna element 110 is formed by a laser engraving method, wherein the antenna element 110 can be formed by directly engraving the substrate on the inner side of the first case 12, or the antenna element 110 can be engraved and attached to the inner side of the first case 12.

The antenna element 110 comprises a connection portion 111, the connection portion 111 is provided for connecting the antenna element 110 with the system antenna module 120. The antenna element 110 further comprises an antenna portion 114 and a ground portion 115; the antenna portion 114 is electrically coupled with the ground portion 115 at a connection point which is treated as a signal feed-in point. The connection portion 111 comprises a first connection portion 112 disposed at the antenna portion 114 and a second connection portion 113 disposed at the ground portion 115.

The system antenna module 120 is disposed in the case 10, with different designs of the electronic apparatus 1, the system antenna module 120 can be disposed independently, or integrated with the system board of the electronic apparatus 1. The system antenna module 120 comprises a corresponding connection portion 121, a position of the corresponding connection portion 121 corresponds to the connection portion 111. The corresponding connection portion 121 comprises a first corresponding connection portion 122 and a second corresponding connection portion 123, the first corresponding connection portion 122 is provided for connecting with the first connection portion 112 of the antenna portion 114, and the second corresponding connection portion 123 is provided for connecting the second connection portion 113 of the ground portion 115, therefore, different signals are transmitted respectively.

Figure 2A:
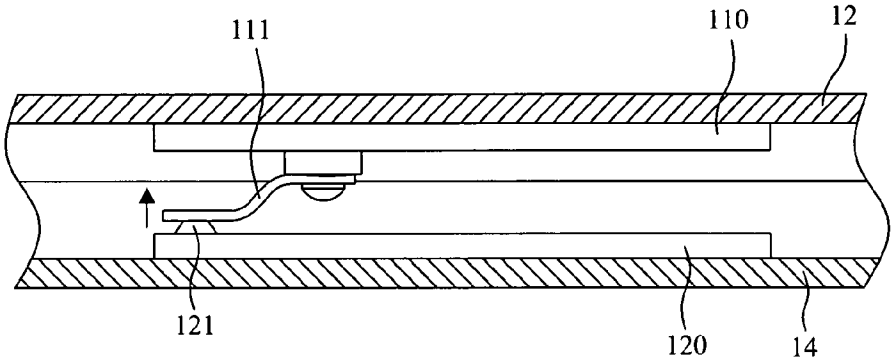
FIG. 2A and FIG. 2B illustrate different combinational views of a connection portion connecting with a corresponding connection portion of the antenna structure in the first embodiment of the present invention.
Figure 2B:
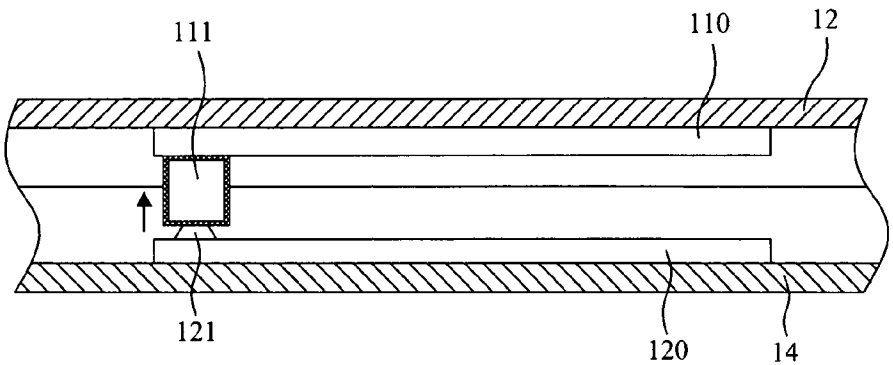

Please refer to FIG. 2A and FIG. 2B for different combinational views of a connection portion 111 connecting with a corresponding connection portion 121 of the antenna structure 100 in the first embodiment of the present invention. As shown in FIG. 1 and FIG. 2A, the connection portion 111 of the antenna structure 100 can be in contact with the corresponding connection portion 121 to form an electrical connection between them by combining the first case 12 and the second case 14. The connection portion 111 of the antenna element 110 is implemented with an elastic conducting structure for using its elastic characteristics to facilitate smooth combination of the first case 12 and the second case 14, and to make sure the corresponding connection portion 121 and the connection portion 111 is in contact with each other to form the electrical connection. Please also refer to FIG. 1, in this embodiment, the connection portion 111 (which includes the first connection portion 112 and the second connection portion 113) uses a spring structure to let a protruded portion of the spring plate be in contact with the corresponding connection portion 121 (which includes the first corresponding connection portion 122 and the second corresponding connection portion 123); and the corresponding connection portion 121 is implemented with a metal pad structure, since the metal pad structure is protruded from the surface of the system antenna module 120, making it easier for the corresponding connection portion 121 to be in contact with the connection portion 111. The corresponding connection portion 121 can be also implemented with a conductive gasket structure to make it protruded and compressible. The corresponding connection portion 121 can be a bare copper and directly connected to the connection portion 111 as shown in FIG. 1, FIG. 2A and FIG. 2B to form the electrical connection.

Also shown in FIG. 2B, in this embodiment, the connection portion 111 is implemented with a conductive gasket structure, when the first case 12 has combined with the second case 14, the conducting portion at the outer rim of the conductive gasket is electrically coupled with the corresponding connection portion 121, and the conductive gasket structure is flexible and compressible. Besides, the connection portion 111 can be implemented with an extendable thimble structure or the like; however, the present invention is not limited thereto.

Also shown in FIG. 1, the electronic apparatus 1 comprises the case 10 and the antenna structure 100 described above in the first embodiment; when the first case 12 combines with the second case 14 of the electronic apparatus 1, the antenna element 110 can be electrically coupled with the system antenna module 120 through the contact of the connection portion 111 and the corresponding connection portion 121 to enable the antenna function of the electronic apparatus 1. This design can totally eliminate the arrangement of connection circuits connecting the components of the antenna structure 100 and saves circuit cost.

Figure 3:
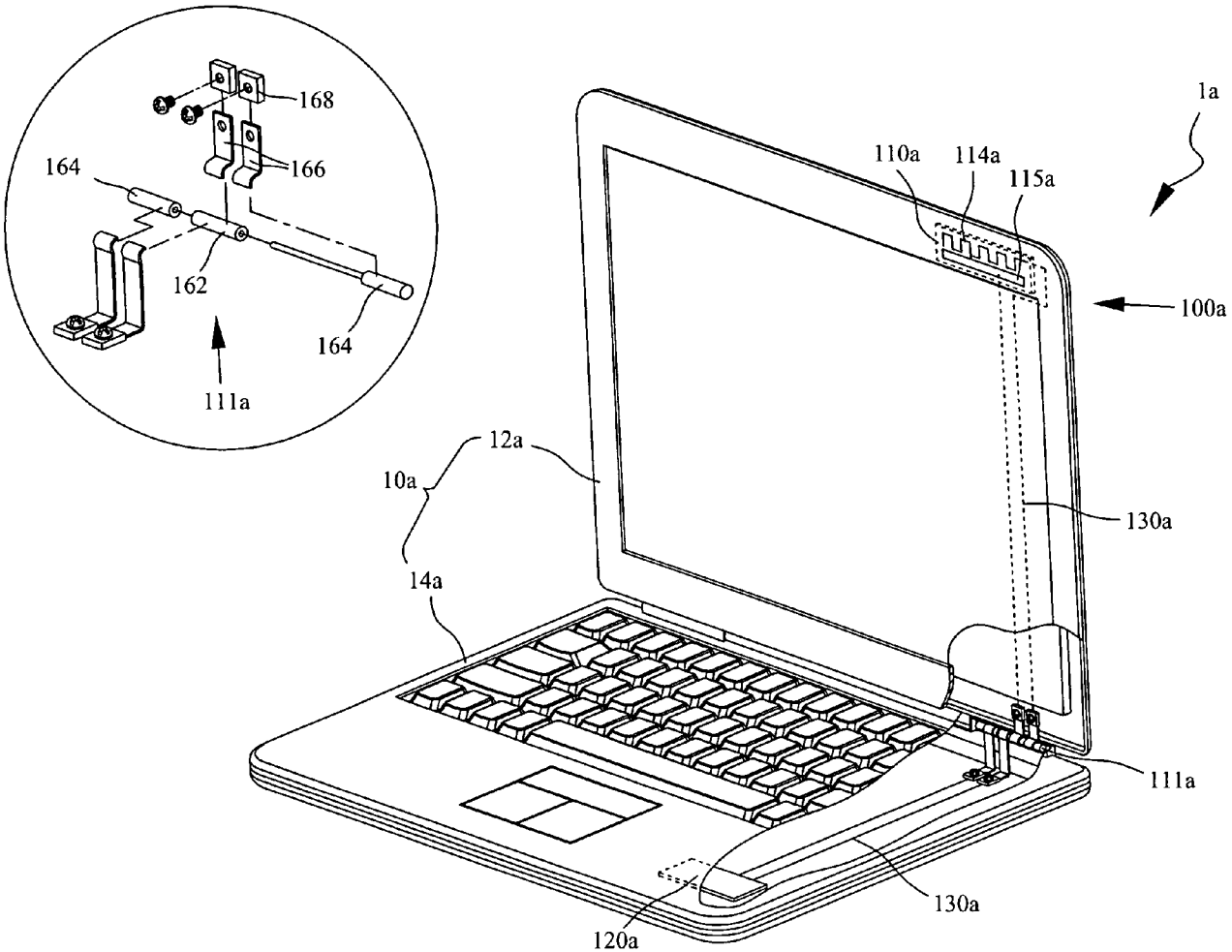
FIG. 3 illustrates a structural view of an antenna structure in a second embodiment of the present invention.

Please refer to FIG. 3 for a structural view of an antenna structure in a second embodiment of the present invention. As shown in FIG. 3, an antenna structure 100*a* is applied in an electronic apparatus 1*a*. The electronic apparatus 1*a* comprises a case 10*a*, wherein the case 10a comprises a first case 12a and a second case 14*a*, the first case 12*a* and the second case 14*a* is connected with each other through a connection portion 111*a*. The antenna structure 100*a* comprises an antenna element 110*a*, a system antenna module 120*a* and at least one connection circuit 130*a*, the antenna element 110*a* is disposed on an inner side of the case 10*a* and the system antenna module 120*a* is disposed at the case 10*a*. the antenna element 110*a*comprises an antenna portion 114*a* and a ground portion 115*a*, the antenna portion 114*a* is electrically coupled with the ground portion 115*a* the antenna portion 114*a* and the ground portion 115*a* are electrically coupled with the at least one connection circuit 130*a* respectively. In this embodiment, the antenna element 110*a* is disposed at the first case 12*a*, that is, the same side as the display, the system antenna module 120*a* is disposed at the second case 14*a*, that is, the same side as the system components. Due to inner space limitations of the electronic apparatus 1*a*, the antenna element 110*a* and the system antenna module 120*a* cannot be disposed together at the second case 14*a*; therefore, it is necessary to find a suitable space in the first case 12*a* for the antenna element 110*a*, and to connect the antenna element 110*a* and the system antenna module 120*a* through a circuit.

The at least one connection circuit 130*a* is electrically coupled between the antenna element 110*a* and the system antenna module 120*a* for transmitting signals, wherein the at least one connection circuit 130*a* is formed on an inner side of the case by a laser engraving method to eliminate the use of traditional physical circuits. In this embodiment, since the first case 12*a* and the second case 14*a* is connected with circuits, the antenna structure 100*a* uses the connection portion 111*a* having a specific structure as a hub for each connection circuit 130*a*, and the connection portion 111*a* enables the antenna element 110*a* and the system antenna module 120*a* to be electrically coupled with each other through each connection circuit 130*a*.

The connection portion 111*a* comprises a first signaling portion 162 and a second signaling portion 164, the second signaling portion 164 is disposed at both ends of the first signaling portion 162; the first signaling portion 162 and the second signaling portion 164 of the connection portion 111*a* are connected with different cables of the at least one connection circuit 130*a* through a plurality of metal parts 166 respectively to separate transmission signals, and joint parts 168 are used for fixing the first signaling portion 162 and the second signaling portion 164. Therefore, the connection portion 111*a* can provide signal transmission capabilities.

Also shown in FIG. 3, the electronic apparatus 1*a* comprises the case 10*a* and the antenna structure 100*a* described above in the second embodiment; with the design of the antenna structure 100*a*, when the at least one connection circuit 130*a* is formed on the inner side of the case 10*a*, the antenna element 110*a* at the first case 12*a* can transmit a signal to the system antenna module 120*a* at the second case 14*a* to enable the antenna function of the electronic apparatus 1*a* and to save circuit costs and inner space of the electronic apparatus 1*a*.

Figure 4:
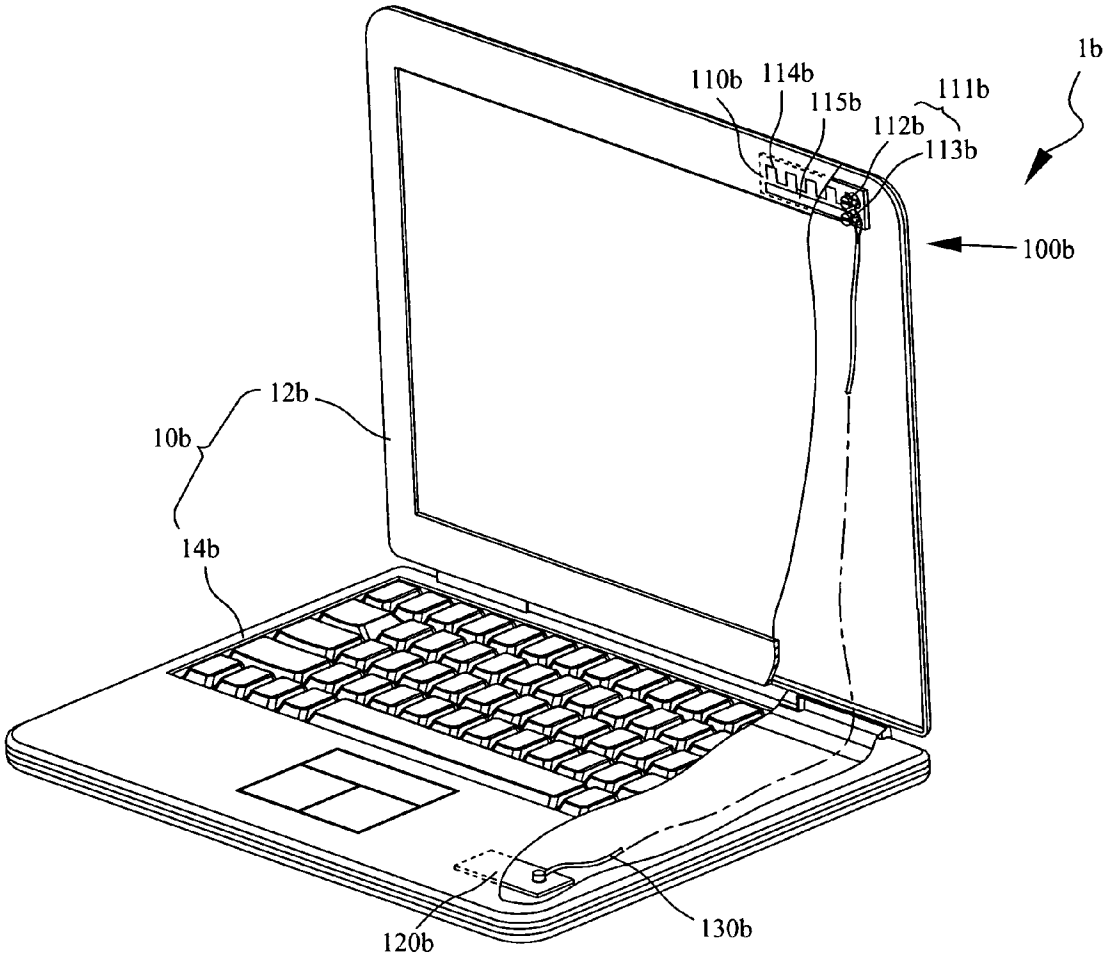
FIG. 4 illustrates a view of an antenna structure in a third embodiment of the present invention.
Figure 5A:
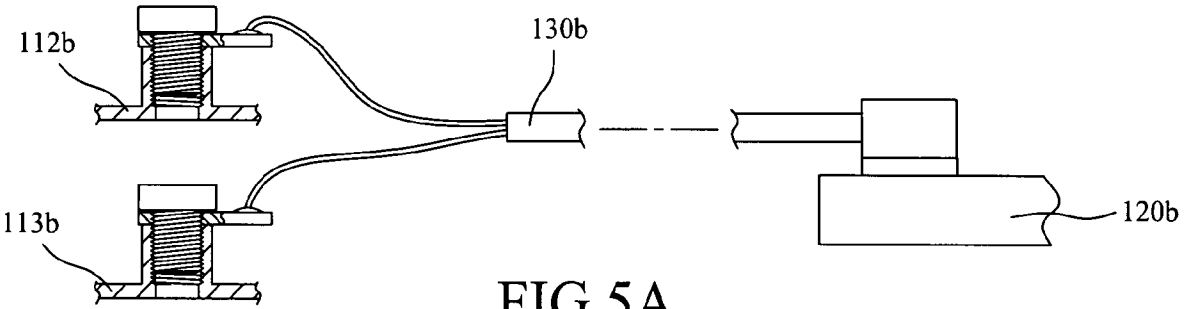
FIGS. 5A, 5B and 5C illustrate different combinational views of at least one connection circuit connecting with an antenna element in the third embodiment of the present invention.
Figure 5B:
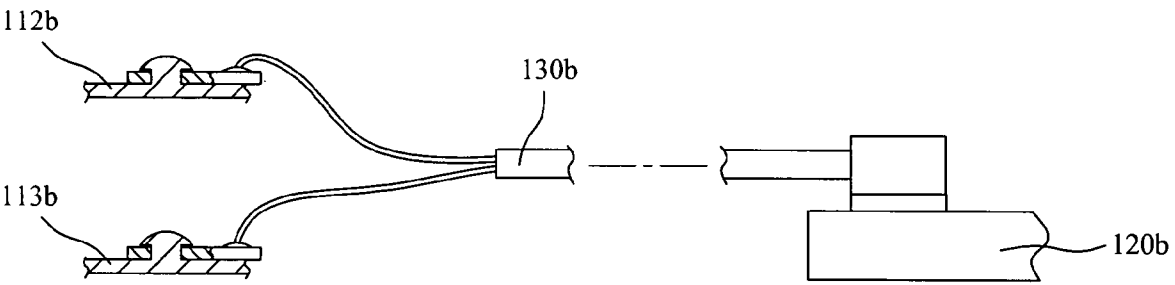
Figure 5C:
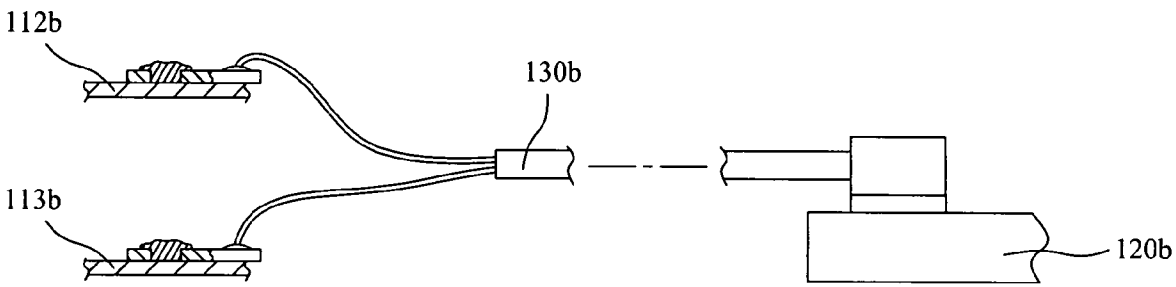

Please refer to FIG. 4 and FIG. 5A to 5C. FIG. 4 illustrates a view of an antenna structure 100*b* in a third embodiment of the present invention; and FIGS. 5A, 5B and 5C illustrate different combinational views of at least one connection circuit 130*b* connecting with an antenna element 110*b* in the third embodiment of the present invention. As shown in FIG. 4 and FIG. 5A, the antenna structure 100*b* is applied in an electronic apparatus 1*b*. The electronic apparatus 1*b* comprises a case 10*b*, wherein the case 10*b* comprises a first case 12*b* and a second case 14*b*. The antenna structure 100*b* comprises an antenna element 110*b*, a system antenna module 120*b* and at least one connection circuit 130*b*; the antenna element 110*b* is disposed on an inner side of the case 10*b* and is formed by a laser engraving method. The antenna element 110*b* comprises a connection portion 111*b*, which comprises a first connection portion 112*b* and a second connection portion 113*b*. The antenna element 110*b* further comprises an antenna portion 114*b* and a ground portion 115*b*, wherein the antenna portion 114*b* is electrically coupled with the ground portion 115*b*, the first connection portion 112*b* is disposed at the antenna portion 114*b*, and the second connection portion 113*b* is disposed at the ground portion 115*b*. The system antenna module 120*b* is disposed in the case 10*b*.

The at least one connection circuit 130*b* is electrically coupled between the antenna element 110*b* and the system antenna module 120*b* for transmitting signals. The at least one connection circuit 130*b* is guided to pass through a reserved portion of a pivot portion of the electronic apparatus 1*b* to connect the antenna element 110*b* and the system antenna module 120*b*, wherein the at least one connection circuit 130*b* is connected to the antenna element 110*b* through the connection portion 111*b*. Some electronic apparatuses 1*b* require physical circuits to act as the signal transmission lines between the antenna element 110*b* and the system antenna module 120*b*; therefore, the at least one connection circuit 130*b* is connected to the connection portion 111*b* of the antenna element 110*b* by a fixing method to ensure stable connection of the connection circuit 130*b* and the laser-engraved antenna element 110*b*, and to facilitate replacement of the at least one connection circuit 130*b* or the antenna element 110*b* when necessary. In this embodiment, each connection circuit 130*b* is fixed to the first connection portion 112*b* and the second connection portion 113*b* by a screw to maintain stable connection between each connection circuit 130*b* and the antenna element 110*b*.

Furthermore, as shown in FIG. 5B, each connection circuit 130*b* can be fixed to the first connection portion 112*b* and the second connection portion 113*b* by a heat fusing method, which heats the hot-melt material disposed on the first connection portion 112*b* and the second connection portion 113*b* to form a firm structure for fixing each connection circuit 130*b* to provide stable connection between them. When it is necessary to replace any component, the hot-melt material is removed, and then a newly replaced component can be fixed by the hot-melt material again. As shown in FIG. 5C, each connection circuit 130*b* can be fixed to the first connection portion 112*b* and the second connection portion 113*b* by a spot welding method, which can be repeated as the heat fusing method.

Therefore, by using the above-described design of the antenna structure 100*b*, the at least one connection circuit 130*b* can be connected with the connection portion 111*b* of the antenna element 110*b* through various connection methods to ensure stable connection between the two and to disconnect them for replacing any components when necessary, thereby facilitating the usability of the electronic apparatus 1*b* and saving maintenance costs.

It is noted that the above-mentioned embodiments are only for illustration, it is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. An electronic apparatus comprising:

a case comprising a first case, a second case, and a connection portion disposed between the first case and the second case for combining the first case and the second case, the connection portion comprising a first signaling portion and a second signaling portion disposed at both ends of the first signaling portion; and an antenna structure comprising:

an antenna element disposed on an inner side of the first case;

a system antenna module disposed in the second case; and at least one laser engraved connection circuit electrically coupled between the antenna element and the system antenna module for transmitting a signal, wherein the at least one laser engraved connection circuit is formed on an inner side of the case and includes first cables and second cables, the first cables being different from the second cables;

wherein the connection portion is electrically coupled with the antenna element and the system antenna module by the at least one connection circuit; and wherein the first signaling portion and the second signaling portion are connected to the antenna element by the first cables of the at least one laser engraved connection circuit and to the system antenna module by the second cables of the at least one laser engraved connection circuit.

2. The electronic apparatus as claimed in claim 1, wherein the antenna element is a laser engraved antenna element.

3. The electronic apparatus as claimed in claim 1, wherein the antenna element comprises an antenna portion and a ground portion, the antenna portion is electrically coupled with the ground portion, and the antenna portion and the ground portion are electrically coupled with the at least one connection circuit respectively.

4. The electronic apparatus as claimed in claim 1, wherein the connection portion is connected with the at least one connection circuit by a plurality of metal parts.

* * * * *